United States Patent [19]

Holloway et al.

[11] 4,396,883

[45] Aug. 2, 1983

[54] BANDGAP REFERENCE VOLTAGE GENERATOR

[75] Inventors: John F. Holloway; Salvatore R. Riggio, Jr., both of Boca Raton, Fla.

[73] Assignee: International Business Machines Corporation, Armonk, N.Y.

[21] Appl. No.: 333,957

[22] Filed: Dec. 23, 1981

[51] Int. Cl.[3] ..... G05F 3/20

[52] U.S. Cl. ..... 323/313; 307/297

[58] Field of Search ..... 307/296, 297; 323/314, 323/315, 313

[56] References Cited

U.S. PATENT DOCUMENTS

| | | | |
|---|---|---|---|
| 3,449,598 | 6/1969 | Wright | 307/297 X |
| 4,029,974 | 6/1977 | Brokaw | 307/297 X |
| 4,323,854 | 4/1982 | Hester | 307/296 R X |

OTHER PUBLICATIONS

"An Integrated Bandgap Reference", G. C. M. Mener & J. B. Verhoeff, IEEE Journal of Solid State Circuits, vol. SC-11, No. 3, pp. 403-406, Jun. 1976.

"A Simple Three-Terminal IC Bandgap Reference", A. Paul Brokaw, IEEE Journal of Solid State Circuits, vol. SC-9, No. 6, Dec. 1974.

Azzis, Integrated Circuit for Temperature Sensing and Thermal Alarm, IBM Technical Disclosure Bulletin, vol. 22, No. 8B, Jan. 1980, pp. 3719-3721.

Azzis, Parallel Bandgap Regulator, Aug. 1977, IBM Technical Disclosure Bulletin, vol. 20, No. 3, pp. 1043-1044.

Azzis, Series Bandgap Cell Regulator, IBM Technical Disclosure Bulletin, vol. 20, No. 4, Sep. 1977, pp. 1475-1476.

Azzis et al., Temperature-Stabilized Voltage Regulator with Laser Trimming Facilities, IBM Technical Disclosure Bulletin, vol. 22, No. 5, Oct. 1979, pp. 1894-1896.

*Primary Examiner*—William M. Shoop

*Attorney, Agent, or Firm*—R. Bee; G. A. Conley; J. Jancin, Jr.

[57] ABSTRACT

A bandgap reference voltage generator consists of a plurality of transistors with the same geometry. This circuit provides a stable temperature-compensated low reference voltage on the order of two volts.

14 Claims, 5 Drawing Figures

BANDGAP REFERENCE VOLTAGE GENERATOR

DESCRIPTION

Technical Field

This invention relates to a bandgap reference voltage generator which provides a temperature compensated low voltage reference.

Background Art

Contemporary electronic circuits frequently require an extremely stable reference potential. One reference potential generating circuit that is particularly desirable is the so-called "band-gap reference" circuit. This circuit uses the substantially constant band-gap voltage of silicon, or similar semiconductor material, as the internal reference potential (the band-gap voltage for silicon is dependent on the doping levels involved, but is on the order of 1.22 V). The band-gap circuit is attractive because of its inherent stability and the capability to generate a relatively low voltage reference potential. As the band-gap circuit is conventionally designed, two transistors are required to operate at different current desities. This has been accomplished by fabricating these transistors with different emitter areas and operating them at equal currents, by using transistors with the same emitter areas and operating them at unequal currents, or by some combination of these two techniques. The prior art band-gap circuits, however, do not provide an optimally temperature independent output voltage because of uncompensated thermal variations in resistances associated with both the bandgap voltage and the output reference voltage.

Disclosure of the Invention

The present invention is a temperature-compensated reference voltage generator which is particularly suitable for generating very low reference voltages on the order of 2 volts or less.

The present invention, uses transistors of identical geometry operating at equal currents to obtain different current densities. Thus, it is very easily fabricated using existing master slice designs. In addition, the present invention exhibits much better temperature stability than prior art circuits. An accurate well regulated low voltage is difficult to obtain because such variations as component tolerances and temperature coefficients are very significant relative to the low output voltage. The use of a specific plurality of transistors in the band-gap circuit or the current supply circuit allows the ratio of resistances affecting the output voltage to be very nearly equal to unity. This eliminates the temperature coefficients of these resistances as factors in the overall temperature stability of the circuit by mutual cancellation.

DESCRIPTION OF THE PREFERRED EMBODIMENT

Figure 1:
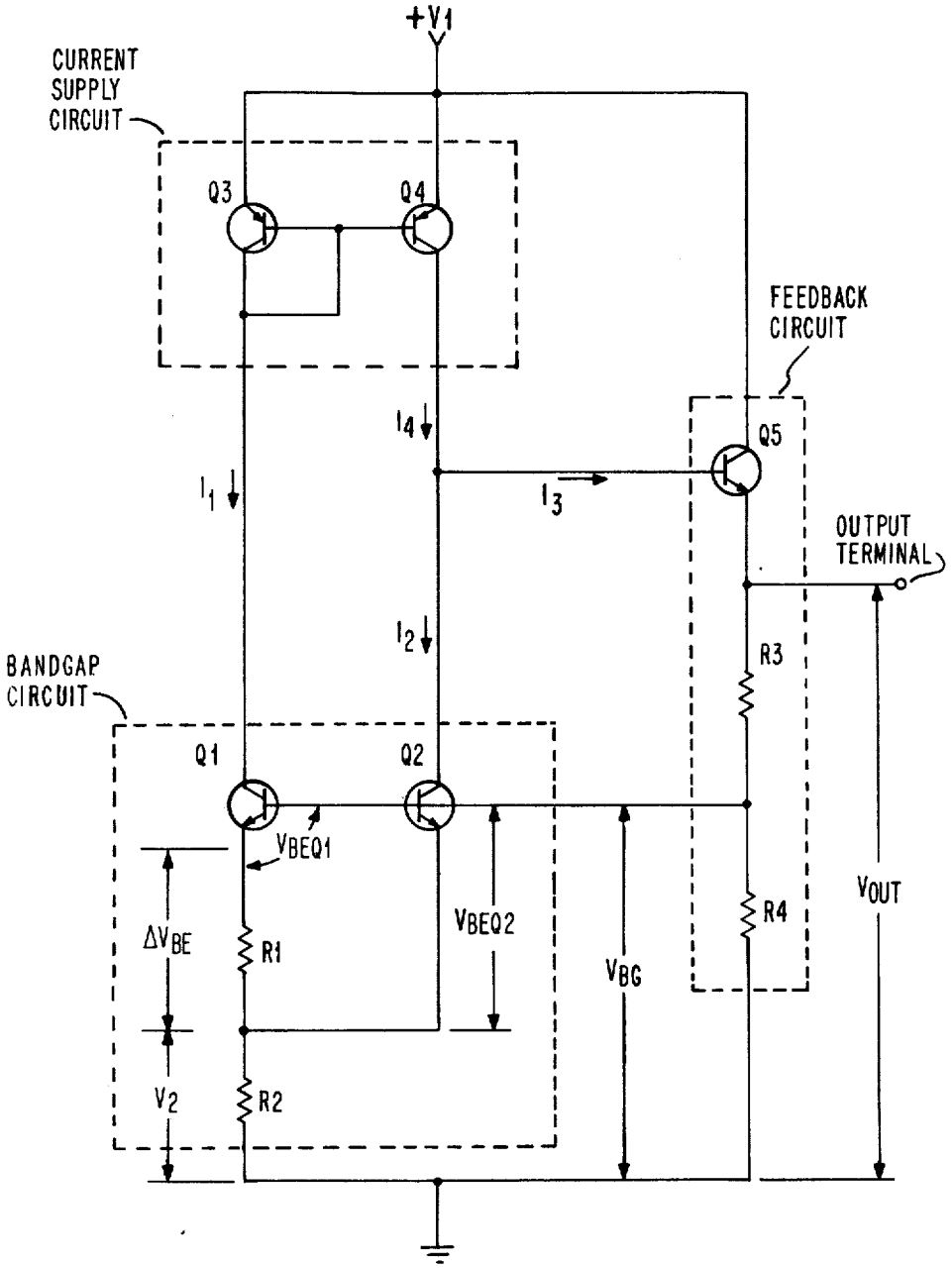
FIG. 1 is a simplified version of the closest prior art.

FIG. 1 illustrates a simplified version of the closest known prior art. This prior art is fully set forth in the preferred embodiment of U.S. Pat. No. 3,887,863 to A. P. Brokaw and also in Brokaw, "A Simple Three-Terminal IC Bandgap Reference", IEEE Journal of Solid State Circuits, December 1974, pp 388–393.

Transistors Q1 and Q2 form a so-called "bandgap" circuit which produces a temperature-compensated output voltage. Transistors Q3 and Q4 form a current supply circuit that cooperates with a feedback circuit which includes transistor Q5 to sense the difference in the collector currents $I_1$ and $I_2$ of Q1 and Q2 and feed back to the base electrodes of Q1 and Q2 the proper voltage for reducing the $I_1$-$I_2$ current difference to zero. For temperature-compensation purposes, it is necessary that the emitter current densities within Q1 and Q2 be different. This is accomplished in the preferred embodiment of the Brokaw circuit by using unequal emitter areas in Q1 and Q2. In the example given, the emitter area of Q1 is made larger than that of Q2 by a ratio of 8 to 1. As is known, the base-to-emitter voltage ($V_{BE}$) of a silicon transistor has a negative temperature coefficient. With equal collector currents $I_1$ and $I_2$ and a smaller emitter current density in Q1, there is produced across resistor R2 a voltage having a positive temperature coefficient. This positive temperature coefficient offsets the negative temperature coefficient of the Q2 base-to-emitter voltage ($V_{BEQ2}$) to produce at the base electrode of Q2 the temperature compensated bandgap voltage $V_{BG}$. For optimum results, the value of resistor R2 is adjusted to make $V_{BG}$ equal to the bandgap voltage for silicon (i.e., approximately 1.22 volts). The voltage $V_{BG}$ is a predetermined fraction of $V_{OUT}$. The current supply circuit formed by Q3 and Q4 forces $I_4$ to be equal to $I_1$. Therefore, if the collector current $I_2$ of Q2 is not equal to $I_1$, the current difference between $I_2$ and $I_4$, namely $I_3$, drives the emitter follower Q5 to adjust the voltage on the base electrode of Q2 to make $I_2$ equal to $I_4$ and, hence, equal to $I_1$.

Figure 2:
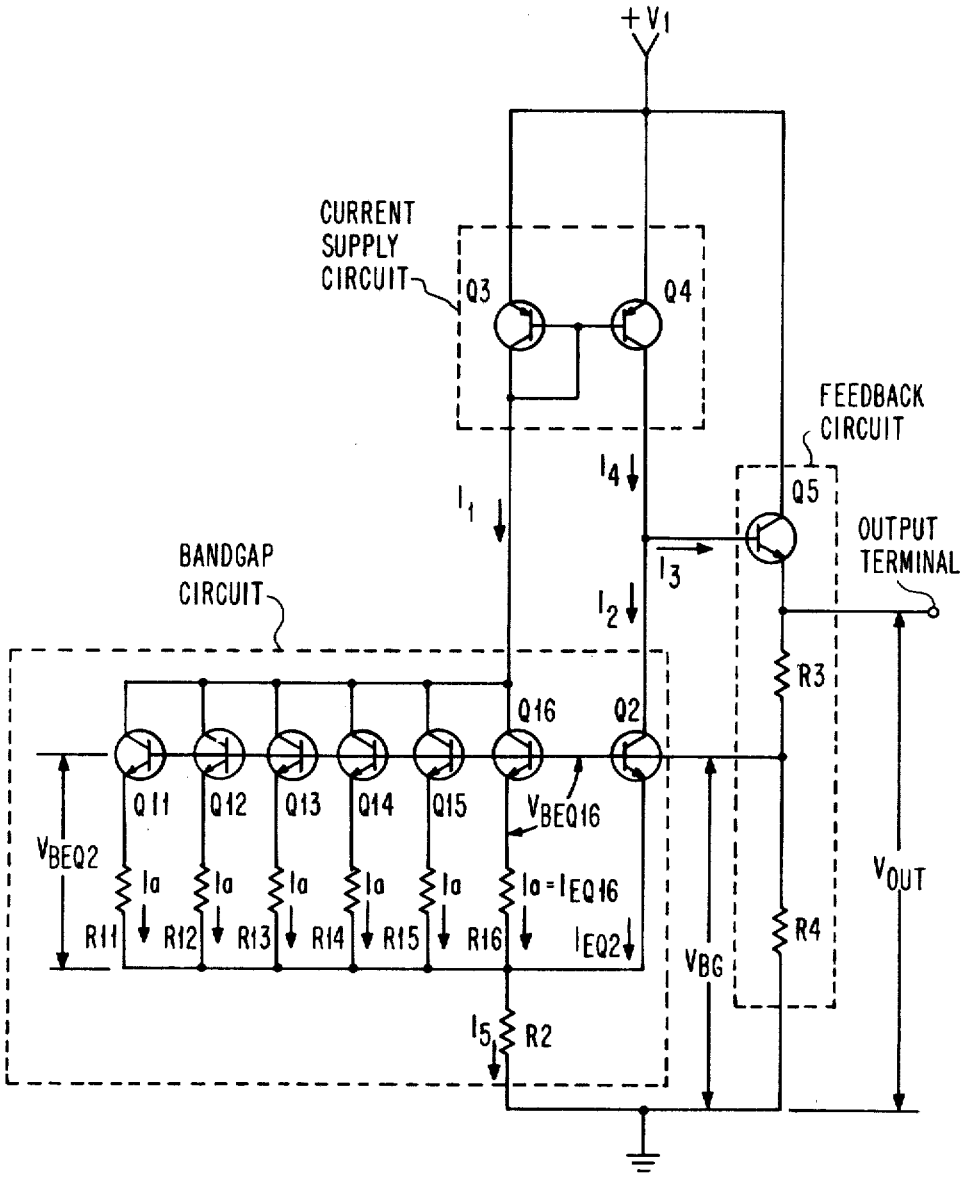
FIG. 2 is a circuit diagram of the preferred embodiment of the present invention.

Referring now to FIG. 2, the preferred embodiment of the present invention is shown. In the present invention, the difference in current densities is obtained by using identical transistors, Q11–Q16 and Q2, operating with different emitter currents. In other words, each of transistors Q11–Q16 is identical to the transistor Q2 and each has the same emitter area as Q2. Because of the parallel arrangement of the transistors Q11–Q16, the current flow and, hence, the emitter current density for each of these transistors Q11–Q16 is one-sixth of the current flow through Q2. This produces across the resistor R2 the voltage having the desired positive temperature coefficient as in the prior art circuit. Note that, as in FIG. 1, transistors Q3, Q4 and Q5 operate to keep $I_2$ equal to $I_1$.

A primary advantage of the present invention is that it provides for an improved temperature stability over the prior art circuit. The use of six identical transistors Q11–Q16 makes the ratio of R11, R12, R13, R14, R15 or R16 to R2 very nearly equal to unity. A simple circuit analysis of FIG. 2 yields the following equations:

$$I_1 = 6I_a \quad (1)$$

$$\Delta V_{BE} = V_{BEQ2} - V_{BEQ16} = \frac{kT}{q} \log_e \frac{J_2}{J_{16}} ; \quad (2)$$

where k = Boltzman's constant, q = the charge of an electron,

T = absolute temperature, and

J = the emitter current density for the subscripted transistor.

$$V_2 = (2)\left(\frac{R2}{R16}\right)(\Delta V_{BE})\text{ (Number of transistors into which } I_1 \text{ is divided)} \quad (3)$$

$$V_{BG} = V_{BEQ2} + 2\left(\frac{R2}{R16}\right)(\Delta V_{BE})\text{ (Number of transistors into which } I_1 \text{ is divided)} \quad (4)$$

$$V_{OUT} = V_{BG} \times \left(\frac{R3}{R4} + 1\right) \quad (5)$$

As indicated by equations (4) and (5), when this ratio of resistances is approximately unity, this eliminates the temperature coefficients of these resistors as a factor in the bandgap voltage and the output voltage and thus improves the temperature stability of the circuit. Note also that R11–R16 are selected to be of equal resistances and that since Q11–Q16 are identical transistors with equal emitter currents, the $V_{BE}$'s of Q11–Q16 (i.e., $V_{BEQ11}$-$V_{VBEQ16}$) are equal.

Specifically, the objectives accomplished by the circuit of FIG. 2 are a voltage reference generator with a $V_{BG}$ equal to the bandgap voltage of silicon transistors Q2 and Q11–Q16, R11–R16 equal to R2 and an output voltage with a nearly zero temperature coefficient. Accomplishing these objectives simultaneously in the same circuit initially requires defining the important relationships which must be considered. It is well known that $$\Delta V_{BE} = \frac{kT}{q} \log_e \frac{J_2}{J_{16}} .$$

Since transistors Q2 and Q11–Q16 are identical, $J_2$ and $J_{16}$ are effectively the emitter currents, $I_{EQ2}$ and $I_{EQ16}$, of transistors Q2 and Q16, respectively where $I_{EQ16} = I_a$. The emitter current $I_{EQ16}$ is a predetermined fraction of current $I_1$ which is determined by the number of transistors into which current $I_1$ is divided (i.e., $I_1 = I_2$ via the interaction between the bandgap circuit, feedback circuit and current supply circuit as previously discussed). Therefore the ratio of one to the number of transistors into which current $I_1$ is divided equals the ratio of $I_{EQ16}$ to $I_{EQ02}$. Once an emitter current is selected for Q2, $\Delta V_{BE}$ is a known value.

After $\Delta V_{BE}$ is calculated based on the selected value of $I_{EQ2}$ the temperature coefficient curve associated with transistors Q2 and Q11–Q16 is examined to obtain the specific value of the temperature coefficient (TC) at the selected emitter currents $I_{EQ2}$ and $I_{EQ16}$ (i.e., $TC_{Q2}$ and $TC_{Q16}$, respectively). The same temperature coefficient curve applies to transistors Q2 and Q11–Q16 because they are all identical transistors. The temperature coefficient curve is developed for each batch of transistors based on their doping levels and technology. This curve is a plot of the change in base-emitter voltage ($V_{BE}$) per °C. (i.e., TC) versus emitter current. As a result a TC is determined for Q2 and Q16 based on the selection of $I_{EQ2}$ and the corresponding value of $I_{EQ16}$ which is dictated by the number of transistors chosen into which $I_1$ is divided. The following relationships are also derived from FIG. 2:

$$R16 = \frac{\Delta V_{BE}}{I_{EQ16}} \quad (6)$$

$$I_5 = \frac{2(TC_{Q2} - TC_{Q16})}{R16} \times \text{number of transistors into which } I_1 \text{ is divided} \quad (7)$$

$$R2 = \frac{TC_{Q2}}{I_6} \quad (8)$$

As $\Delta V_{BE}$ and $I_{EQ16}$ are known, R16 can be calculated. Likewise $I_5$ and R2 can be calculated from previously determined parameters. At this point, the values of R16 and R2 are known. If R16 is not approximately equal to R2, then the analysis process set forth above is repeated. If R2 is greater than R16, the number of transistors into which $I_1$ is divided is increased. If R2 is less than R16, the number of transistors into which $I_1$ is divided is decreased. When this iteration process results in R2 approximately equal to R16, $V_{BG}$ is determined.

Again by a circuit analysis of FIG. 2, the following relationships are apparent:

$$V_2 = R2[I_{EQ2} + (I_{EQ16} \times \text{number of transistors into which } I_1 \text{ is divided})] \quad (9)$$

$$V_{BEQ2} = \frac{kT}{q} \log_e \frac{I_{EQ2}}{I_s} , \quad (10)$$

where $I_s$ is the saturation current of $Q_2$ $$V_{BG} = V_2 + V_{BEQ2} \quad (11)$$

The value of $V_{BG}$ is thus determined from these relationships. If $V_{BG}$ is not equal to the bandgap voltage of transistors Q2 and Q11–Q16, the process associated with equating R2 and R16 above is repeated until $V_{BG}$ is equal to the appropriate bandgap voltage, R2 is approximately equal to R16, and $V_{BG}$ has a zero temperature coefficient.

Figure 3:
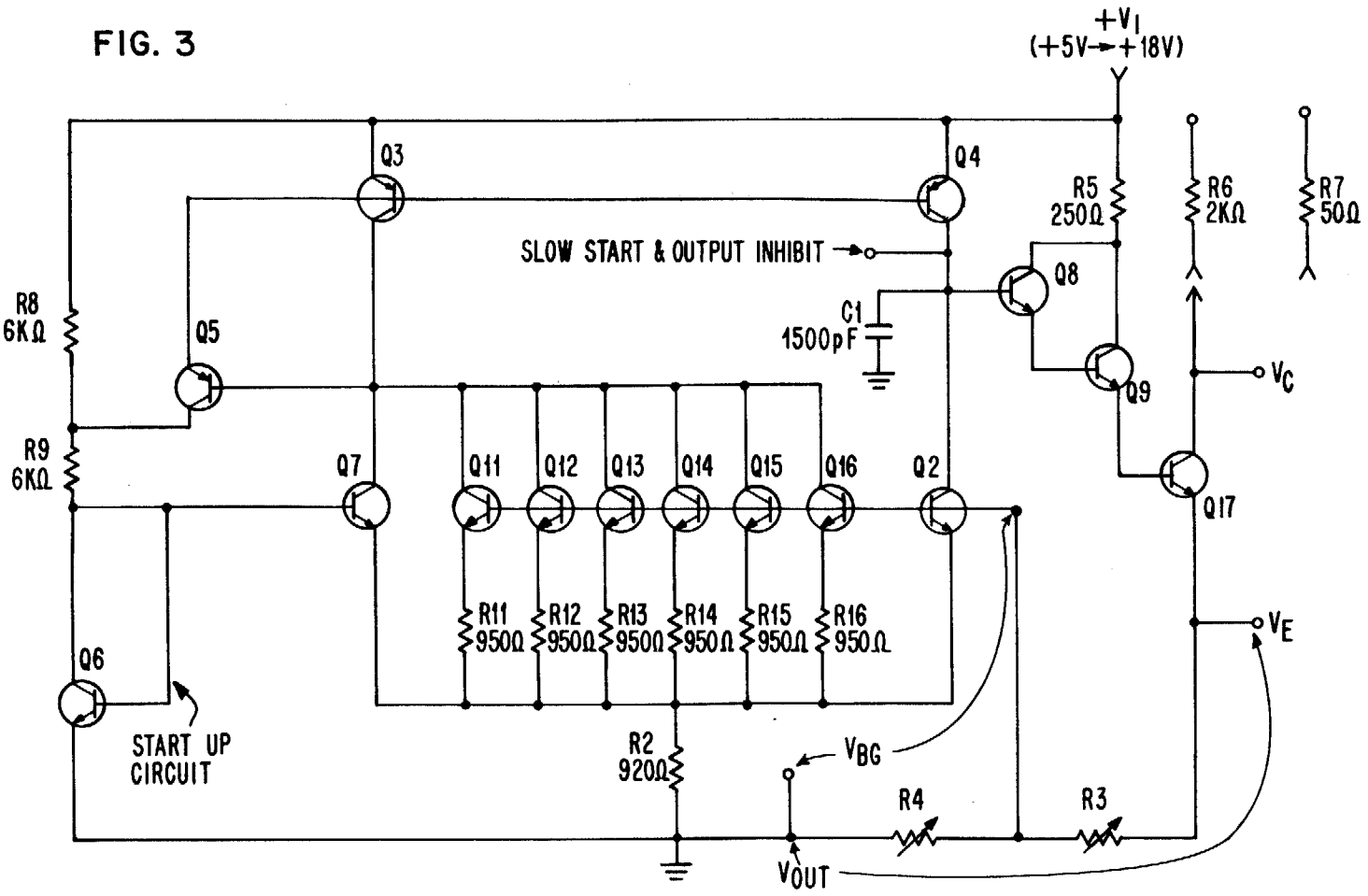
FIG. 3 is a practical embodiment of the present invention.

Referring now to FIG. 3, a practical embodiment of the present invention which results from the iterative process explained above is shown. This particular circuit is capable of generating a +1.7 V output (i.e., $V_{OUT}$) from a +5.0 V input (i.e., $V_1$). Currently, there are no linear devices available on the market which can generate a +1.7 V output from a +5.0 V input. If input voltages of higher than 5 volts are used, the efficiency of the +1.7 V output is greatly reduced. Switching regulation has been used to generate a +1.7 V output, however, this technique is a non-linear regulation method. The circuit in FIG. 3 has a simple start-up circuit and a flexible universal output drive circuit. The output device circuit is flexible because the collector and emitter ($V_C$ and $V_E$) of output transistor Q17 are made accessible utilizing the 2KΩ and 50Ω pull-up resistors, R6 and R7, for many different drive applications. When power is applied Q6 is turned on through R8 and R9. This causes a current to flow momentarily in Q7, such that Q5, Q3 and Q4 will turn on and start up the band-gap cell, Q11 through Q16 and Q2. Q7 will then turn-off, Q6 will stay on and the band-gap cell will remain in an on-stable-state. This circuit also contains a slow-start and output inhibit function which allows the output voltage to be brought up to value at a specified rate by using an external capacitor C1. Slow-start means that the rate of voltage rise at $V_{OUT}$ may be adjusted by placing an external capacitor in parallel with C1 from the slow-start-output inhibit point to ground. The value of this capacitor may be calculated from the following equation:

$$C1 = \frac{T(I_{EQ16})}{V_{OUT} + V_{BEQ8} + V_{BEQ17} + V_{BEQ9}} - .015\ \mu f$$

($T$ is Time in milli-seconds)

The larger C1 is, the slower the rise or start of $V_{OUT}$. The same point in the circuit can also be used to inhibit the output voltage from an External Sense and Control circuit such as an overcurrent sense.

Laser trimming of the output and comparison circuits is also accomplished. Laser trimming of the output circuit provides greater accurracy due to the type of trim used, that is, Ratio Trimming. This type of trim allows the output voltage to be set to the target value whether the output voltage, at pre-trim, is higher or lower than the required Nominal Target Value. This is done by trimming R3 if the output is low or R4 if the output is high where R3 and R4 are a pair of output resistors. Also, if there is an over-shoot the opposite resistor can be trimmed to bring the output voltage back to target value. The circuit in FIG. 3 also includes a known compound darlington output circuit which includes Q8, Q9, Q17 and R5.

While trimming the output circuit is done to initialize the output voltage, $V_{OUT}$, to as accurate a value as possible, trimming the resistors in the comparison transistor circuit (R11 through R16 and R2) is done to set the temperature coefficient to 0° C. The comparison transistor circuit adjusts itself to maintain a constant output voltage, $V_{OUT}$, as the ambient temperature rises and falls. This is accomplished by trimming R11 through R16 and R2 at a consistent known temperature, and monitoring the output voltage, $V_{OUT}$.

Figure 4:
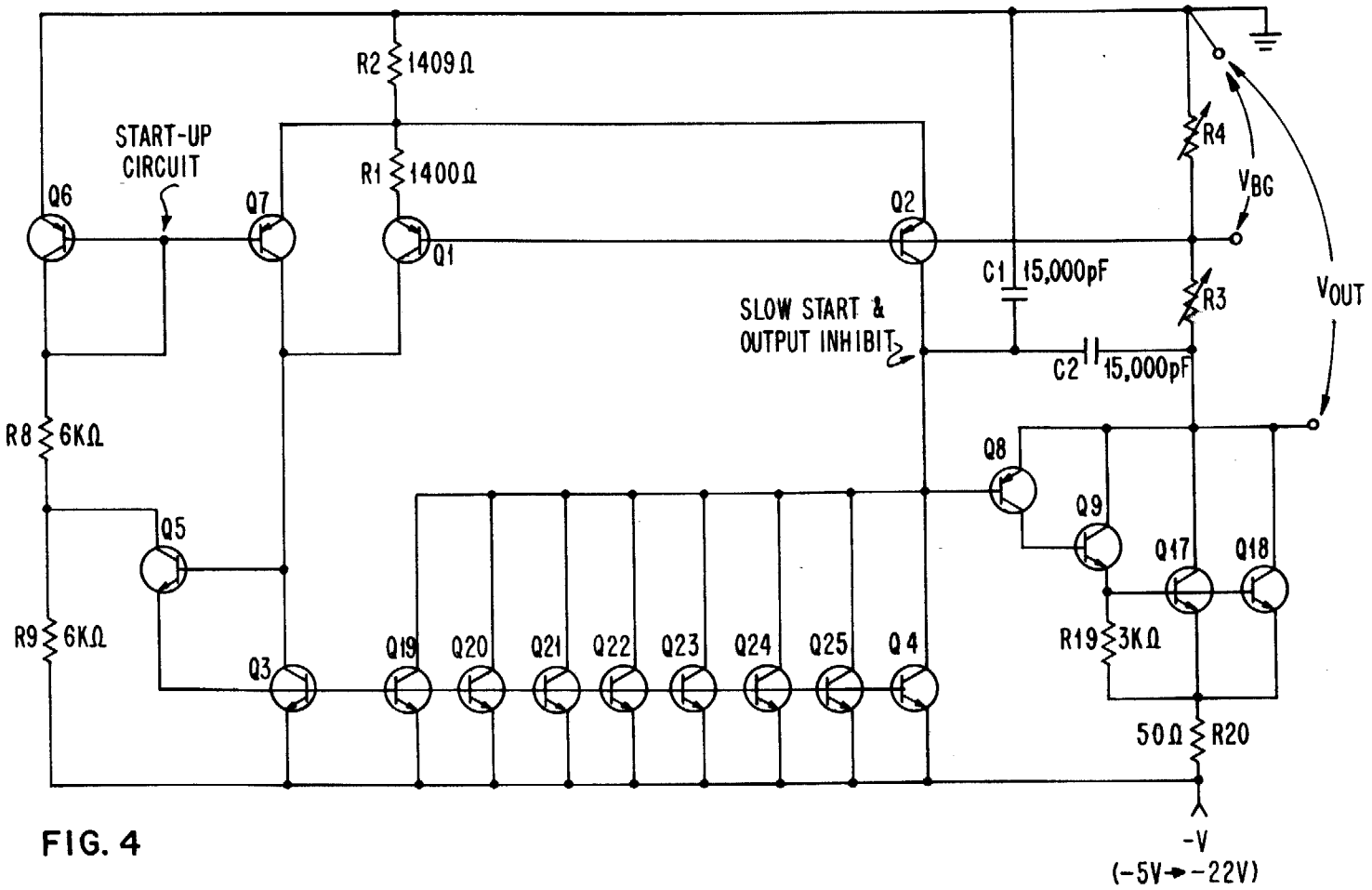
FIG. 4 is a negative reference circuit embodiment of the present invention.

Referring now to FIG. 4, a practical embodiment of the present invention is shown in which the reference voltage output, $V_{OUT}$, is generated by comparing the $V_{BE}$ temperature coefficients of two PNP transistors, Q1 and Q2, with identical geometries and different emitter currents. This results in a negative bandgap cell (i.e., Q1 and Q2).

In this arrangement the iterative process previously discussed is applied to a two transistor bandgap circuit and a multitransistor current supply instead of a multitransistor bandgap circuit and a two transistor current supply circuit. This approach results in different currents in identical transistors Q1 and Q2 to achieve different current densities in Q1 and Q2. The number of transistors feeding Q2 is adjusted until R1 is approximately equal to R2, $V_{BG}$ is equal to the bandgap voltage of Q1 and Q2, and the output voltage has a zero temperature coefficient. The relationships (i.e., equations 1-11) previously set forth to determine the optimum component values and quantities for FIG. 2 and FIG. 3 are again used for FIG. 4 with the following adjustments:

Replace $J_{16}$ with $J_1$

Replace $I_{EQ16}$ with $I_{EQ1}$

Replace $TC_{Q16}$ with $TC_{Q1}$

Replace the "number of transistors into which $I_1$ is divided" with the "number of transistors feeding Q2"

All of these replacements are the result of the same simple circuit analysis process previously performed in conjunction with FIG. 2.

FIG. 4 also includes a known compound darlington output circuit which includes Q8, Q9, Q17, Q18, R19, R20 and C2. The capacitor C2 is commonly used to compensate for phase shifts in the darlington and thereby prevent the output from oscillating.

Figure 5:
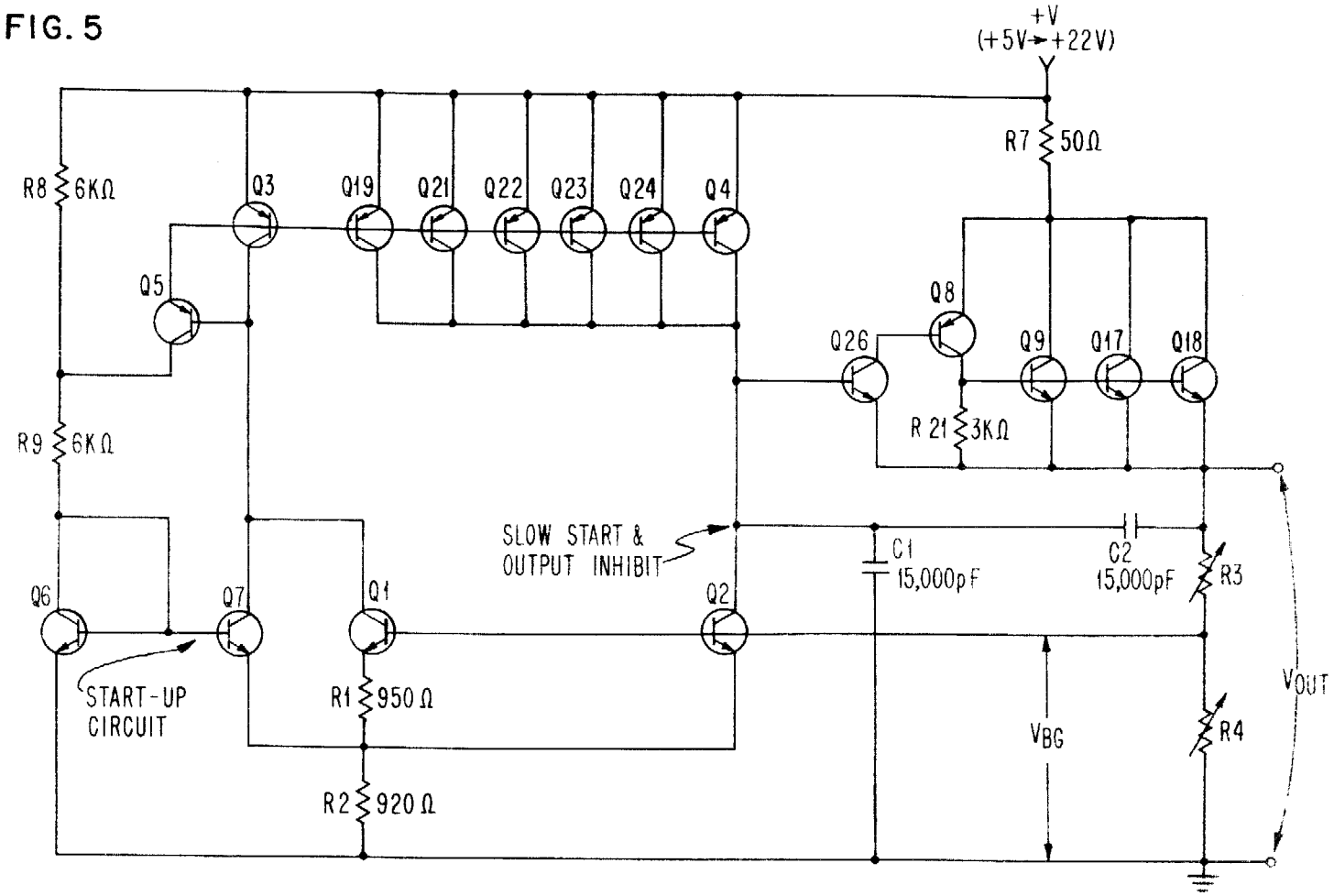
FIG. 5 is a positive reference circuit embodiment of the present invention.

Referring now to FIG. 5, an embodiment is shown equivalent to the embodiment shown in FIG. 4 except that NPN transistors, Q1 and Q2 are used to form a positive band-gap cell (i.e., Q1 and Q2). The iterative process associated with FIG. 4 is also employed here to determine the appropriate number and values of the circuit components used such that R1 is equal to R2, $V_{BG}$ is equal to the bandgap voltage of Q1 and Q2, and the output voltage has a zero temperature coefficient.

While we have illustrated and described the preferred embodiments of our invention, it is to be understood that we do not limited ourselves to the precise constructions herein disclosed and the right is reserved to all changes and modifications coming within the scope of the invention as defined in the appended claims.

We claim:

1. A temperature compensated reference voltage generator circuit comprising:

a current supply circuit;

a first transistor having its collector coupled to a first side of said current supply circuit;

a first resistor coupled between the emitter of said first transistor and a second side of said current supply circuit;

a plurality of transistors of the same geometry as said first transistor, each having its collector coupled to said first side of said current supply circuit;

a plurality of resistors each of approximately the same resistance as said first resistor, individually coupled between the emitter of a respective one of said plurality of transistors and the emitter of said first transistor;

a feedback circuit means coupled to a first side of said current supply circuit, the base of said first transistor and the bases of said plurality of transistors, a second side of said current supply circuit, and the collector of said first transistor; said feedback circuit responsive to the difference between the current flowing through said first transistor and the total current flowing through all of said plurality of transistors for supplying a voltage to the bases of said first transistor and said plurality of transistors to reduce this difference in current flow to substantially zero; and an output terminal means coupled to said feedback circuit means for providing a stable temperature-compensated reference voltage;

whereby said reference voltage is not substantially effected by thermally induced resistance variations in said first resistor and said plurality of resistors.

2. A reference voltage generator circuit according to claim 1 wherein said feedback circuit means further comprises:

a second transistor having its collector coupled to a first side of said current supply means, its emitter coupled to said output terminal means, and its base coupled to the collector of said first transistor; and a pair of resistors connected in series between the emitter of said second transistor and a second side of said current supply means, and another connection between the bases of said first transistor and said plurality of transistors and the junction between said pair of resistors.

3. A reference voltage generator circuit according to claim 2 wherein said output terminal means is connected to the junction between the emitter of said second transistor and the first resistor of said pair of resistors.

4. A reference voltage generator circuit according to claim 2 wherein said current supply means further comprises:

a pair of transistors whose bases are connected together, whose emitters are connected together and then further connected to a positive voltage, the first transistor of said pair of transistors further has its collector connected to its own base and the base of the second transistor of said pair of transistors;

the first transistor of said pair of transistors further has its collector connected to all the collectors of said plurality of transistors;

the second transistor of said pair of transistors has its collector connected to the collector of said first transistor and to the base of said second transistor.

5. A reference voltage generator circuit according to claim 4 wherein said positive voltage is approximately 5 volts.

6. A temperature compensated reference voltage generator circuit comprising:

a current supply circuit;

a start-up circuit coupled to a first side of said current supply circuit;

a first transistor having its collector coupled to said first side of said current supply circuit and a second side of said current supply circuit;

a first resistor coupled between the emitter of said first transistor and said second side of said current supply circuit;

a plurality of transistors of the same geometry as said first transistor, each having its collector coupled to said start-up circuit and said first side of said current supply circuit;

a plurality of resistors each of approximately the same resistance as said first resistor, individually coupled between the emitter of a respective one of said plurality of transistors and the emitter of said first transistor;

a feedback circuit coupled to said start-up circuit, said first side of said current supply circuit, and said collectors of said plurality of transistors; said feedback circuit responsive to the difference between the total current flowing through said plurality of transistors and the current flowing through said first transistor for supplying a voltage to the bases of said plurality of transistors and said first transistor to reduce this difference in current to substantially zero;

a compound darlington output circuit coupled to said first side of said current supply means for providing a stable temperature compensated reference voltage;

a slow start and output inhibit circuit coupled to said second side of said current supply circuit, said compound darlington output circuit, said first side of said current supply circuit, and the collector of said first transistor which allows said reference voltage to be brought up to value at a specified rate;

a pair of output resistors coupled to said compound darlington output circuit, said start-up circuit, said second side of said current supply circuit, and the bases of said first transistor and said plurality of transistors; and a pair of pull-up resistors capable of being coupled to said compound darlington output circuit;

wherein said reference voltage is not substantially effected by thermally induced resistance variations in said first resistor and said plurality of resistors.

7. A reference voltage generator circuit according to claims 1 or 6 wherein said plurality of transistors is six.

8. A temperature compensated reference voltage generator circuit comprising:

a current supply circuit with a first and second side, said first side of said current supply circuit including a first transistor and a plurality of transistors;

a start-up circuit coupled to said first side of said current supply circuit and said second side of said current supply circuit;

a bandgap circuit further comprising:

a second transistor coupled to said start-up circuit;

a third transistor coupled to the base of said second transistor and the first side of said current supply circuit;

a first resistor coupled to the emitters of said second and third transistors and said start-up circuit;

a second resistor of approximately the same resistance as said first resistor coupled to said first resistor and said start-up circuit;

a feedback circuit coupled to said bandgap circuit, said start-up circuit and said first side of said current supply circuit; said feedback circuit responsive to the difference between the total current flowing through said plurality of transistors and the current flowing through said first transistor for supplying a voltage to the bases of said plurality of transistors and said first transistor to reduce this difference in current to substantially zero;

a compound darlington output circuit coupled to said bandgap circuit and said first side of said current supply circuit for providing a stable temperature compensated reference voltage;

a slow start and output inhibit circuit coupled to said second side of said current supply circuit, said bandgap circuit, and said compound darlington output circuit which allows said reference voltage to be brought up to value at a specified rate;

a pair of output resistors coupled to said second side of said current supply circuit, said bandgap circuit, and said compound darlington output circuit;

wherein said reference voltage is not substantially effected by thermally induced resistance variations in said first resistor and said second resistor.

9. A reference voltage generator circuit according to claim 8 wherein said second transistor and said third transistors are PNP transistors which makes said bandgap circuit a negative bandgap circuit.

10. A reference voltage generator according to claim 8 wherein said second transistor and said third transistor are NPN transistors which makes said bandgap circuit a positive bandgap circuit.

11. A reference voltage generator circuit according to claims 1, 6 or 8 wherein said stable temperature-compensated reference voltage is on the order of two volts or less.

12. A reference voltage generator circuit according to claims 1, 6 or 8 wherein said circuit is fabricated as an integrated circuit.

13. A reference voltage generator circuit according to claims 8 or 9 wherein said plurality of transistors is eight.

14. A reference voltage generator circuit according to claims 8 or 10 wherein said plurality of transistors is six.

* * * * *